United States Patent [19]

Cadwell et al.

[11] Patent Number: 4,964,661

[45] Date of Patent: Oct. 23, 1990

[54] TWO-PART CASING LATCHING MECHANISM

[75] Inventors: Peter F. Cadwell, Sunnyvale; Noah L. Anglin, San Jose, both of Calif.

[73] Assignee: Poget Computer Corporation, Sunnyvale, Calif.

[21] Appl. No.: 373,768

[22] Filed: Jun. 30, 1989

[51] Int. Cl.[5] ..... E05C 3/04

[52] U.S. Cl. ..... 292/87; 292/337; 292/DIG. 38

[58] Field of Search ..... 292/80, 86, 87, 121, 292/128, DIG. 38, 337, 88, 89

[56] References Cited

U.S. PATENT DOCUMENTS

| | | | |
|---|---|---|---|
| 718,081 | 1/1903 | Bracket | 292/86 X |
| 1,531,953 | 3/1925 | Kendall | 292/86 X |
| 4,270,668 | 6/1981 | Berfield | 292/87 X |
| 4,344,646 | 8/1982 | Michel | 292/87 |

OTHER PUBLICATIONS

Item #6148634, "Digital Diary", Reliable Home Office Catalog, Summer 1989.

*Primary Examiner*—Richard E. Moore

*Attorney, Agent, or Firm*—Skjerven, Morrill, MacPherson, Franklin & Friel

[57] ABSTRACT

A pocket-type computer encompassed by a two-part casing has the entire latch mechanism contained in sidewalls of upper and lower hinged casings. The sidewalls have a thickness of only about two millimeters. A latch plate is integrally molded in a sidewall interior recess or formed as a molded part and fixedly adhered in the recess. One end of an elongated latch is fixed in an interior recess in the upper casing sidewall and depends therefrom so that a centilevered end having locking tooth slides on an inclined surface on the latch plate as the casings are closed until the latch tooth springs into a recess and keeper in the latch plate. An integral push button extends outwardly from the latch at a medial position into a matching aperture in the upper casing sidewall. The push button is accessed from the casing exterior and when pushed inwardly, the latch is pivoted inwardly releasing the latch tooth from the latch keeper to allow opening of the two casings. After opening, a user can then operate the computer, more particularly a keyboard in the lower casing and view a display screen provided in the interior of the upper casing.

8 Claims, 2 Drawing Sheets

TWO-PART CASING LATCHING MECHANISM

CROSS-REFERENCE TO RELATED APPLICATION

This application relates to U.S. Pat. application No. 07/373,769, filed concurrently herewith, entitled Hinged Casing in the name of Peter F. Cadwell and Noah L. Anglin and assigned to an assignee common to this application. The disclosure of such related application is hereby incorporated herein by reference.

FIELD OF THE INVENTION

The invention pertains to a latch-type closure for a two-piece casing. More particularly the invention is directed to a latch mechanism for a pocket-type computer which mechanism is essentially contained within the wall thickness of both halves of a two-part casing such that the casing has an essentially smooth exterior and retains a maximum interior volume for the computer components.

BACKGROUND OF THE INVENTION

The most common construction of a personal computer is a stand-alone desk-type computer using magnetic disk drives. Such computers, for exmple the Apple MacIntosh computer, utilize a relatively large one-piece casing and significant power. This type of construction cannot be employed in so-called lap-type computers, let alone in an extremely small pocket-type computer. Such lap-type and pocket-type computers normally utilize memory cards and other miniature electronic components. So as to accommodate a display screen lap-type and pocket-type computers have employed a two-piece or multi-piece housing or casing with an upper casing containing the display screen.

In these devices each incremental part of the internal casing inch volume is important so to accommodate the required components. For example, the Zenith SuperSPort 286 Model includes a multi-piece casing in which a hinged upper casing incorporates a viewing screen and contains a pair of slidable hook-type latches in relatively wide side margins which depend outwardly from the upper casing. A lower casing from which a computer keyboard projects has side margins corresponding to the side margins of the upper casing and a pair of apertures to receive the hook-type latches. A suitable latch keeper and pairs of movable latching members are mounted within these side margins and co-act with cam surfaces on the latches to lock the casings together when the casings are pivoted into abutment to the container "closed" condition. Ribbed switch-type operators extend from the exterior of the casing and are accessed from the exterior of the upper casing side margins to release the latch hooks from the keeper and to allow hinged movement of the upper casing to a container "open" condition where the keyboard can be accessed and the screen observed by the user. Both side margins are relatively wide (i.e. about 10 millimeters) to accommodate these various latch elements.

Many other two-part general usage containers have an integral latch plate extending and accessed from the exterior of a bottom casing with a latch tab member extending downwardly from an exterior edge portion of an upper casing so that as the latch tab member is slid into engagement with lips on either side of a latch keeper, the latch member engages the keeper and latches the casings in a closed condition. Pulling the tab member outwardly releases the lock action and the tab member is slid upwardly from the lips to allow the casings to be in an "open" condition.

In another commercial computer product, the CASIO Digital Diary calculator and memory unit, a two-piece casing includes a depending latch inboard of the upper casing sidewall and an aperture bridging a keyboard and the sidewall of the lower casing. It appears that the sidewalls, including the latch mechanisms in this construction, are about 5 mm in width.

SUMMARY OF THE INVENTION

The latch mechanism of the invention is incorporated in a computer two-part casing, more particularly within the confines of a 1–2 millimeter wide sidewall of both the upper and lower casings. This results in a maximum interior volume for reception of computer components while minimizing the exterior dimensions of the overall casing. Since it is desired to have the overall computer fit a user's typical clothing pocket width the thickness of the latching mechanism must be extremely small. The overall exterior dimensions of the concerned computer in which the latching mechanism of the invention finds initial utility is about 22 mm thick × 107 mm wide × 220 mm long. The casing's sidewall structure essentially prevents entry of dirt and debris into the casing interior but yet allows easy opening and closing. Only a nonprotruding push button(s) is apparent on the exterior of the overall computer casing which button need be pressed inwardly only about 0.025 mm to effect release of a pivoted latch member on one casing part from a latch keeper on the other casing part.

In one embodiment a single latch is provided in the front middle of the casing and in a second embodiment a double latch is provided, one at each forward end of the overall casing. Each embodiment utilizes the same latch mechanism. The latch plate of each mechanism may be integrally molded in the concerned sidewall or be in the form of a separate molded part which is adhesively bonded into a recess in a sidewall. The latch itself is a one piece molded plastic part which is snapped into a recess in an upper casing sidewall and contains an integral push button passing through an aperture in the lower casing sidewall so that the "push" surface is planar with or slightly below the exterior plane of the adjacent sidewall. This prevents any protuberance on the two-part casing which might be caught on threads or edges of a user's clothing pocket or in a pocket of an attache or other carrying case in which the two-part casing computer may be stored. A complete computer is thus contained in the upper and lower casings with the latching mechanism all contained in the extremely thin (1–2 mm) sidewalls. Pushing on the push button frees a latch "tooth" (on the latch extending from the upper casing) from a latch keeper in the sidewall of the lower casing. The casings can then be opened. The opposing spring force to the action of finger or nail pressure on the push button is caused by the latch spring pivot which when moved inwardly a small amount tends to form a return force to place the latch tooth back into a lock position. When the two casings are hingedly close together the cantilevered end of the latch engages an inclined tapered strike face surface on the latch plate above the latch keeper, again forcing the latch to pivot inwardly so that upon complete closure the latch return force moves the tooth outwardly to engage the keeper below the inclined surface and to a point, it is captured by a re-entrant recess in the latch plate.

The above-described latch mechanism has but one moving part, i.e. the pivoted latch, with movement of that latch being restricted to only about 0.025 mm. This provides a latch mechanism fitting inside a wall thickness of the order of 1–2 mm. A low-cost housing thus results which essentially has no interior volume dedicated to a latch mechanism. The latch mechanism can be used in any two-part casing in the jewelry box, toy and other fields as well as in a hand-held computer.

DETAILED DESCRIPTION

Figure 1:
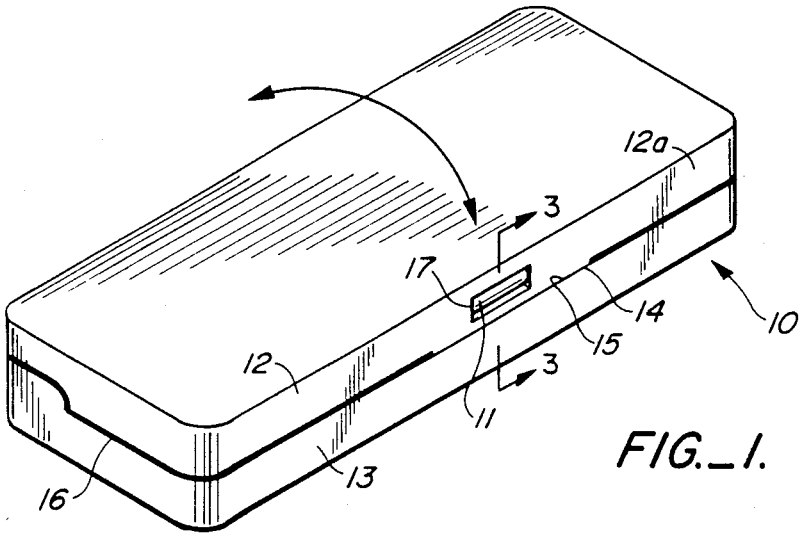
FIG. 1 is an exterior perspective view of a first embodiment of the invention in a closed condition.

As seen in FIG. 1, a pocket-type computer 10 is encompassed by a two-part container including an upper casing 12 hingedly mounted at its rear to a lower casing 13. The upper casing thus can be pivoted to an "open" and "closed" position of the overall container. In the "closed" position, peripheral edge portions 14, 15 of the respective casings are in abutment. For aesthetic purposes, a trim recess 16 may be provided on side and front surfaces of one of the casings for reception of a color-coordinated contrast strip. Extending through an aperture 17 in the front side wall 12*a* is a push button 11 having an outer surface, preferably planar, with the exterior of sidewall 12*a* or slightly recessed in the aperture so as to allow access by finger or nail pressure to press the push button inwardly a small (about 0.02–0.03 mm) amount for latch release.

Figure 2:
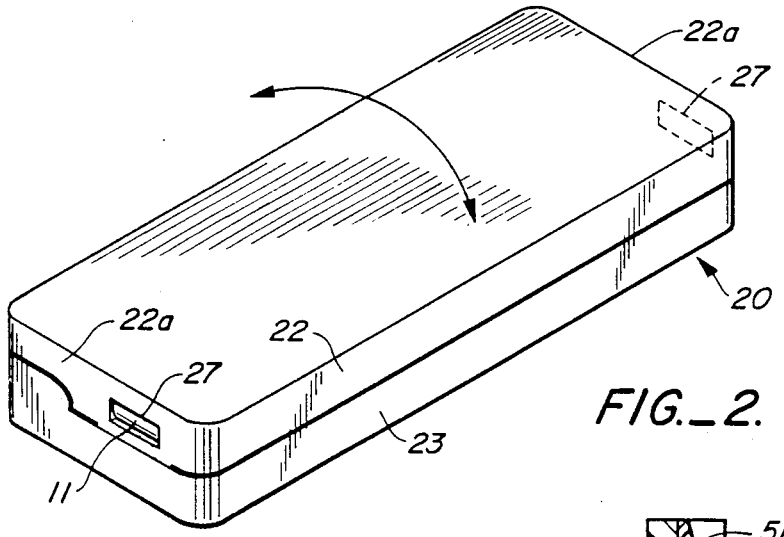
FIG. 2 is an exterior perspective view of a second embodiment of the invention.

FIG. 2 illustrates a second embodiment of a pocket-type computer 20 having an upper hinged casing 22 and a lower casing 23, the former having a pair of apertures 27 at each end 22*a* of the upper casing. Duplicate latch mechanisms having a push button 11 positioned in each aperture 27 are provided in each sidewall 22*a*. A user merely pushes the button on each end of the upper casing to release the latches and be able to open the container, thus exposing a computer keyboard (not shown) in the lower casing and a view screen (not shown) in the upper casing.

Figure 3:
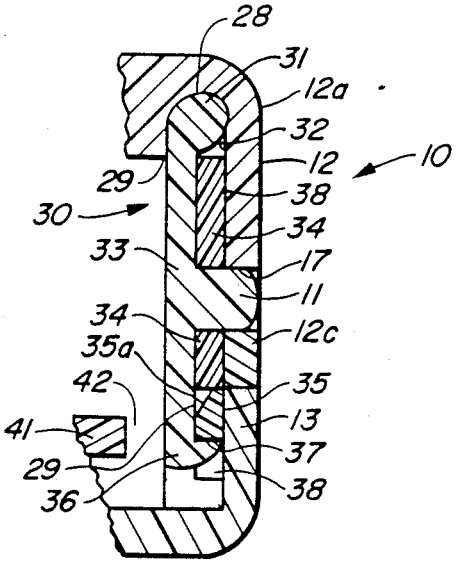
FIG. 3 is a cross-sectional view of the sidewalls of the casings taken on the line 3—3 of FIG. 1.
Figure 9:
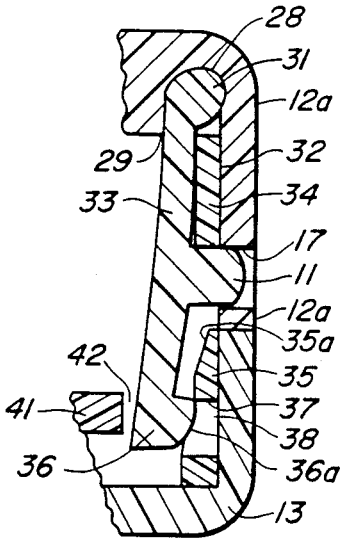
FIG. 9 is a schematic cross-sectional view of the latching mechanism showing the unlatching position (push button "in") of the latch member.

FIG. 3 shows the latch mechanism 30 in locking position with a latch plate 35. The latch plate 35 is shown as a separate molded part having a top inclined strike surface 35*a* and a re-entrant surface 37. A latch 33 has a first end 31 fixed in a recess 28 of sidewall 12*a*. Once placed in the recess 28, the latch is captured therein by fixedly mounting a back-up plate 34 by a plastic adhesive 38 such as "Black Max", a cyanoacrylate adhesive in a recess 32 in sidewall 12*a*. A push button 11 integral with and extending from a medial position of the latch 33 extends through an aperture in plate 34 and into sidewall aperture 17 so that its outside surface is planar with or slightly below the outer surface 12*c* of sidewall 12*a*. An inner surface of latch 33 forms a line contact 29 with an edge of recess 28. As seen in FIG. 9, inward pushing of the push button 11 results in the latch 33 pivoting about this line contact. A locking "tooth" 36 is provided at the cantilevered opposite end of latch 33 which has a surface 36*a* (FIG. 9) which slides during the closing operation on inclined strike surface 35*a* until the inherent spring return of the latch 33 returns the cantilevered end and the tooth into locking abutment with the re-entrant surface 37. The tooth is then captured in recess 38 in the latch plate. As seen in FIG. 9, pushing of the push button inwardly disengages the lock tooth from surface 37 and out of recess 38 allowing the container casings to be separated. The latch 33 during this push action pivots about line contact 29 sufficient to clear surface 37 but being limited in flexability so as not to impinge on the edge of a printed circuit board 41 or other computer component in the container. Thus, a clearance gap 42 is provided rearward of the latch tooth.

Figure 5:
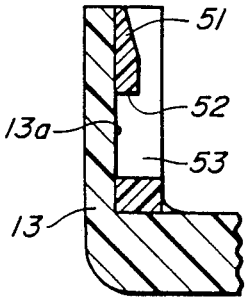
FIG. 5 is a cross-sectional view of a latch plate taken on the line 5—5 of FIG. 4.
Figure 4:
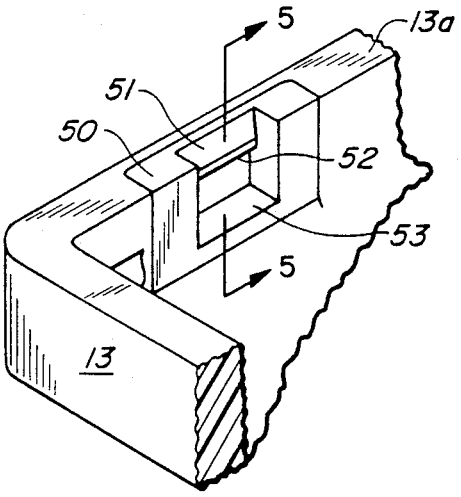
FIG. 4 is a perspective view of a corner of a lower casing showing a discrete molded latch plate adhesively bonded in a sidewall recess.

FIGS. 4 and 5 illustrate an embodiment wherein the latch plate is a single molded part 50 having an inclined strike surface 51 and a keeper 52 into which the locking tooth of latch 33 interfits in recess 53. The entire strike plate 50 is within the sidewall 13*a* of the upper casing 13. In FIG. 4, the latch mechanism is shown in a casing corner as in FIG. 2.

Figure 6:
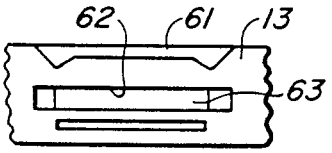
FIG. 6 is a back view of a lower casing sidewall showing an integrally molded latch plate.

FIG. 6 shows a back view taken from inside the lower casing of FIG. 1 illustrating a central latch plate molded integral with the front sidewall 13. An inclined strike surface 61 tends to push the latch 33 inwardly upon downward hinged movement of the upper casing so that when the reentrant recess 63 is reached, the latch tooth springs outwardly to have the tooth top surface abut the keeper surface 62.

Figure 7:
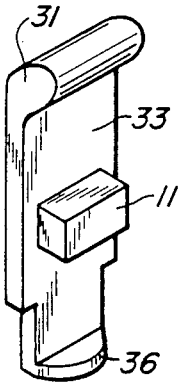
FIG. 7 is a perspective view of one embodiment of the latch member.
Figure 8:
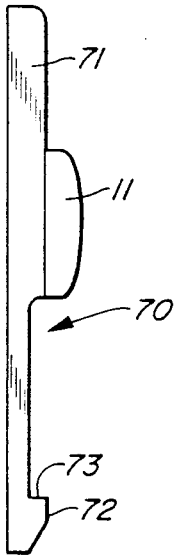
FIG. 8 is a side view of a second embodiment of the latch member.

FIG. 8 is a modified latch 70 having a nonbulbous end 71 which is pressed into a matching configured recess in the upper casing interior sidewall. As in FIG. 7, push action on the button 11 will release the cantilevered end 72 and the latch tooth surface 73 from the latch keeper on the bottom casing to allow opening of the casings, for computer use, as described above with respect to FIG. 9.

The upper and lower casings are of unitary construction made from a material having electrically insulating characteristics, preferably a moldable plastic such as Lexan® polycarbonate or ABS plastic (acrylonitrile-butadiene-styrene).

The above description of embodiments of this invention is intend to be illustrative and not limiting. Other embodiments of this invention will be obvious to those skilled in the art in view of the above disclosure.

We claim:

1. A latching mechanism for a molded plastic hinged container for a computer having an upper casing and a lower casing, each of said upper casing and said lower casing having a peripheral sidewall of a predetermined of the order of 1 to 2 mm. in thickness for maximizing an interior volume of said container for reception of computer operating components;

means for forming a recess in an inner peripheral surface of one of said sidewalls and a latch keeper extending parallel to said one sidewall and forming a wall bounding said recess;

an elongated molded plastic latch pivotably extending from an inner periphery of the remaining peripheral sidewall, said latch having a cantilevered end in latching abutment with said latch keeper when said upper casing and bottom casing are in container "closed" condition; and push button means integrally with and extending outwardly from said latch through an aperture in one of said sidewalls and being operable for pivoting said latch to release the latching abutment of said latch cantilevered end and said latch keeper and to allow opening of said container.

2. The latching mechanism of claim 1 wherein said remaining sidewall includes an inner peripheral recess, said latch having an opposed end opposite the cantilevered end and fixed in said remaining wall recess and wherein inward movement of said push button pivots said latch along an entrance edge of said remaining side wall recess.

3. A latching mechanism for a hinged container having an upper casing and a lower casing, each of said upper casing and said lower casing having a peripheral sidewall of a predetermined thickness;

a latch plate including a latch keeper recessed in an inner peripheral surface of one of said sidewalls;

an elongated latch pivotably extending from an inner periphery of the remaining peripheral sidewall, said latch having a cantilevered end in latching abutment with said latch keeper when said upper casing and bottom casing are in container "closed" condition;

push button means extending outwardly from said latch through an aperture in one of said sidewalls and being operable for pivoting said latch to release the latching abutment of said latch end and said latch keeper and to allow opening of said container;

wherein said remaining sidewall includes an inner peripheral recess, said latch having an opposed end opposite the cantilevered end and fixed in said recess and wherein inward movement of said push button pivots said latch along an entrance edge of said recess; and in which said recess is curvilinear in cross-section and extends linearly along a portion of said remaining sidewall and said latch opposed end has a cross-section matching and a width corresponding to the width of said remaining sidewall portion.

4. The latching mechanism of claim 1 further including a latch plate in said sidewall inner peripheral surface, said latch plate and said latch keeper being integrally formed in a one-piece construction with said one sidewall.

5. The latching mechanism of claim 1 wherein said latch keeper is in said bottom casing and said latch pivotably extends downwardly from said upper casing, said push button integrally extending from a medial position of said latch.

6. The latching mechanism of claim 1 including a pair of latch keepers in said bottom casing and a pair of latches pivotably extending downwardly from said upper casing, and wherein a push button on each of said latches are accessible from opposed sidewalls of said upper casing.

7. The latch mechanism of claim 1 wherein said aperture and said push button are positioned medially of a front sidewall of said upper casing.

8. The latch mechanism of claim 1 wherein said sidewalls having a width of about 2 millimeters.

* * * * *

UNITED STATES PATENT AND TRADEMARK OFFICE

CERTIFICATE OF CORRECTION

PATENT NO. : 4,964,661
DATED : October 23, 1990
INVENTOR(S) : Peter F. Cadwell, et. al.

It is certified that error appears in the above-indentified patent and that said Letters Patent is hereby corrected as shown below:

Title page, item [73], Assignee: "Poget Computer Corporation" should be--Poqet Computer Corporation--.

Signed and Sealed this

Thirtieth Day of August, 1994

*Attest:*

*Attesting Officer*

BRUCE LEHMAN

*Commissioner of Patents and Trademarks*